US007368885B2

(12) United States Patent
Takeda et al.

(10) Patent No.: US 7,368,885 B2
(45) Date of Patent: May 6, 2008

(54) LIGHTING CONTROLLER FOR LIGHTING DEVICE FOR VEHICLE

(75) Inventors: Hitoshi Takeda, Shizuoka (JP); Masayasu Ito, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 11/590,021

(22) Filed: Oct. 31, 2006

(65) Prior Publication Data

US 2007/0096561 A1 May 3, 2007

(30) Foreign Application Priority Data

Oct. 31, 2005 (JP) ..... 2005-315717

(51) Int. Cl.
*H05B 37/02* (2006.01)

(52) U.S. Cl. ..... 315/308; 315/82

(58) Field of Classification Search ..... 315/77–82, 315/291, 209 R, 308, 307, 360; 307/9.1, 307/10.1, 10.8; 362/800
See application file for complete search history.

(56) References Cited

U.S. PATENT DOCUMENTS 6,297,761 B1 * 10/2001 Barrenscheen et al. ..... 341/166
6,320,275 B1 * 11/2001 Okamoto et al. ..... 307/10.1
7,158,361 B2 * 1/2007 Horn ..... 361/154
2004/0217712 A1 * 11/2004 Takeda et al. ..... 315/82

FOREIGN PATENT DOCUMENTS

JP 2004-330819 11/2004

* cited by examiner

*Primary Examiner*—Thuy V. Tran
*Assistant Examiner*—Ephrem Alemu
(74) *Attorney, Agent, or Firm*—Osha Liang LLP

(57) ABSTRACT

A lighting controller for a lighting device for a vehicle includes a semiconductor light source; a power source for supplying electric power; and control circuitry for receiving the electric power from the power source and controlling a current supplied to the semiconductor light source. The control circuitry determines an amount of time the semiconductor light source is in a turned on state and an amount of time the semiconductor light source is in a turned off state. The control circuitry controls a value of the current supplied to the semiconductor light source based on both the determined amount of time the semiconductor light source is in a turned on state and the determined amount of time the semiconductor light source is in a turned off state. A method of controlling a lighting device for a vehicle includes receiving electric power from a power source; supplying a current to a semiconductor light source, determining an amount of time the semiconductor light source is in a turned on state and an amount of time the semiconductor light source is in a turned off state, and controlling a value of the current supplied to the semiconductor light source based on both the determined amount of time the semiconductor light source is in a turned on state and the determined amount of time the semiconductor light source is in a turned off state.

3 Claims, 7 Drawing Sheets

Vs
Vth

Vs
Vth

Vs
Vth

LIGHTING CONTROLLER FOR LIGHTING DEVICE FOR VEHICLE

BACKGROUND OF INVENTION

1. Field of the Invention

The present invention relates to a lighting controller for a lighting device for a vehicle, and more particularly to a lighting controller for a lighting device for a vehicle constructed so as to control the lighting of a semiconductor light source composed of semiconductor light emitting element.

2. Background Art

As a lighting device for a vehicle, a lighting device using a semiconductor light emitting element such as an LED (light Emitting Diode) as a light source has been hitherto known. On such kind of lighting device for a vehicle, a lighting control circuit for controlling the lighting of the LED is mounted.

When the LED is controlled to be turned on using the lighting control circuit, a control for always supplying a constant current to the LED can be employed. However, the LED has characteristics that when the temperature of the LED rises, even if the same forward current is supplied to the LED, the light flux of emitted light (a quantity of light) is lowered. Therefore, when a control for always supplying a constant current to the LED is carried out, the quantity of light is sequentially lowered due to the self-heat generation of the LED itself. Especially, when a heat radiating structure is used for the purpose of raising the temperature to a temperature as high as the maximum junction temperature of the LED in view of cost or size, the amount of decrease of the quantity of light is more drastic. When the quantity of light is lowered, a visibility is lowered for a driver, so that there is a fear that the driver cannot perform driving safely. Further, when the LED is used as a headlight or a signal light of a vehicle, the LED may possibly not satisfy required product standards.

Further, because the LED has an unevenness of the forward voltage Vf, when a prescribed current is supplied to the LED, an electric power applied to the LED having a higher forward voltage Vf is high, so that a heat generation is greater. Accordingly, as the lighting control circuit, a lighting control circuit needs to be used that has a capability and a size that allows supply of the electric power anticipating the unevenness of the forward voltage Vf of the LED. Further, the heat radiating structure of the LED needs to have a size, a form, and a thermal resistance anticipating the heat generation of the LED.

Thus, to ensure a necessary quantity of light even when the temperature of the LED rises, a lighting control circuit has been proposed in which a time during which the LED continuously emits light is measured and a current supplied to the LED is increased in accordance with the measured time (see Patent Document 1).

[Patent Document 1] JP-A-2004-330819.

As described in Patent Document 1, the lighting time during which the LED continuously emits light is measured and the current supplied to the LED is controlled to increase in accordance with the measured time, so that the quantity of emitted light of the LED can be prevented from falling in accordance with the rise of temperature.

SUMMARY OF INVENTION

When the quantity of emitted light of the LED is always controlled to be constant, the current of the LED needs to be controlled by considering not only the time that the LED is turned on, but also, the time that the LED is turned off. That is, the temperature of an LED at the time of initial turning on of the LED is different depending on the amount of time that the LED was turned off before the initial turning on. For instance, when the LED is in a turned on state for a long time, then, is turned off and turned on again in a short time, because the LED is already in a state of a high temperature, a larger current than that required at a low temperature needs to be supplied to the LED. In contrast, when the LED is turned off for a long time and then turned on under a sufficiently cooled state, because the LED is in a state of the low temperature, a smaller current than that required at the high temperature needs to be supplied to the LED.

One or more embodiments of the present invention maintain a quantity of emitted light of a semiconductor light source to be constant irrespective of the temperature of the semiconductor light source.

In one or more embodiments, a lighting controller for a lighting device for a vehicle comprises: a current supply control unit for receiving the supply of an electric power from a power source to control the supply of a current to a semiconductor light source; and a time measuring unit for measuring a turned on time and a turned off time of the semiconductor light source. The current supply control unit sequentially further increases the value of the current supplied to the semiconductor light source as the turned on time measured by the time measuring unit is longer and further increases the value of the current supplied to the semiconductor light source at the time of initial turning on of the semiconductor light source when the turned off time is shorter.

When the supply of the current to the semiconductor light source is controlled, because the temperature of the semiconductor light source is indirectly measured, the turned on time and the turned off time of the semiconductor light source are measured. Then, as the turned on time of the semiconductor light source is longer, the temperature of the semiconductor light source is determined to be sequentially more elevated and the value of the current supplied to the semiconductor light source is sequentially further increased. Accordingly, a quantity of the emitted light of the semiconductor light source can be prevented from being lowered in accordance with the rise of the temperature of the semiconductor light source and the quantity of the emitted light of the semiconductor can be maintained to be constant. Further, when the semiconductor light source is turned on, as the turned off time is shorter, it is determined that the heat of the semiconductor light source is not adequately radiated, and accordingly, the semiconductor light source is in a state of a high temperature. Thus, the value of the current supplied to the semiconductor light source is increased, so that the quantity of the emitted light of the semiconductor light source can be prevented from being lowered during turning on the semiconductor light source and the quantity of the emitted light of the semiconductor light source can be maintained to be constant. That is, the current of the semiconductor light source is controlled to meet the change of the temperature of the semiconductor light source, and accordingly, the quantity of the emitted light of the semiconductor light source can be maintained to be constant irrespective of the temperature of the semiconductor light source.

In one or more embodiments, a lighting controller for a lighting device for a vehicle further comprises: a voltage detecting unit for detecting the forward voltage of the semiconductor light source. The current supply control unit sequentially further increases the value of the current supplied to the semiconductor light source as the forward voltage detected by the voltage detecting unit is lower.

When the current is supplied to the semiconductor light source, the forward voltage of the semiconductor light source is detected. As the forward voltage is lower, namely, as the temperature of the semiconductor light source is higher, the value of the current supplied to the semiconductor light source is sequentially further increased, so that the quantity of the emitted light of the semiconductor light source can be maintained to be constant. In this case, the detected result of the voltage detecting unit is used as a back up. Thus, even when the time measuring unit is failed, the quantity of the emitted light of the semiconductor light source can be maintained to be constant irrespective of the temperature of the semiconductor light source.

In one or more embodiments, in a lighting controller for a lighting device for a vehicle, the current supply control unit limits the current supplied to the semiconductor light source to a limit value or lower when the value of the current supplied to the semiconductor light source reaches the limit value.

When the value of the current supplied to the semiconductor light source reaches the limit value, the current supplied to the semiconductor light source is limited to a value not higher than the limit value, so that the thermorunaway of the semiconductor light source can be prevented and a heat radiating structure for radiating the heat of the semiconductor light source can be miniaturized.

As apparent from the above-description, according to the lighting controller for a lighting device for a vehicle in accordance with one or more embodiments, the quantity of the emitted light of the semiconductor light source can be maintained to be constant irrespective of the temperature of the semiconductor light source.

According to one or more embodiments, even when the time measuring unit is failed, the quantity of the emitted light of the semiconductor light source can be maintained to be constant irrespective of the temperature of the semiconductor light source.

According to one or more embodiments, the thermorunaway of the semiconductor light source can be prevented and the heat radiating structure for radiating the heat of the semiconductor light source can be miniaturized.

Other aspects and advantages of the invention will be apparent from the following description and the appended claims.

DETAILED DESCRIPTION

Figure 1:
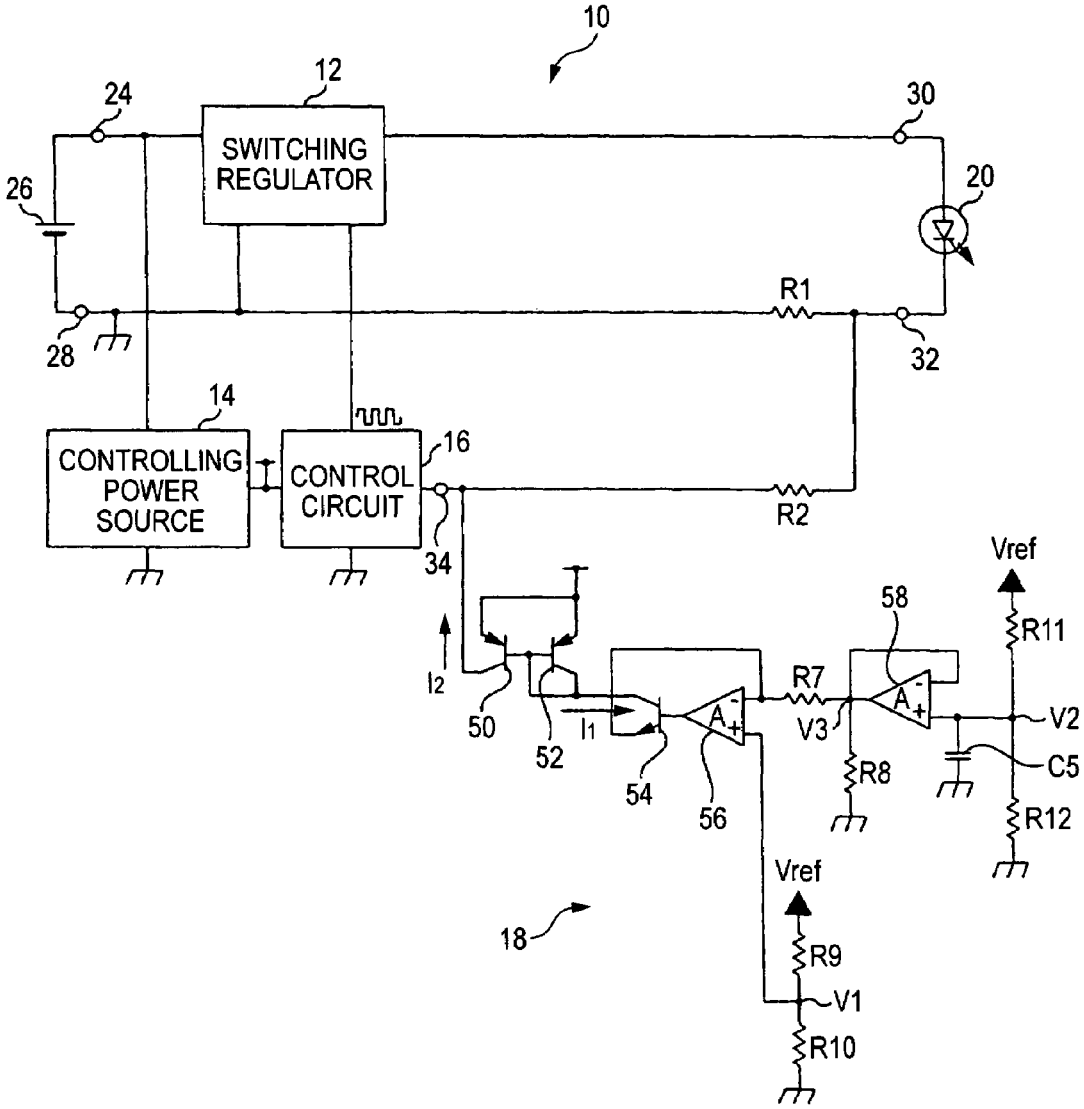
FIG. 1 is a circuit block diagram of a lighting controller for a lighting device for a vehicle showing a first embodiment of the present invention.
Figure 2:
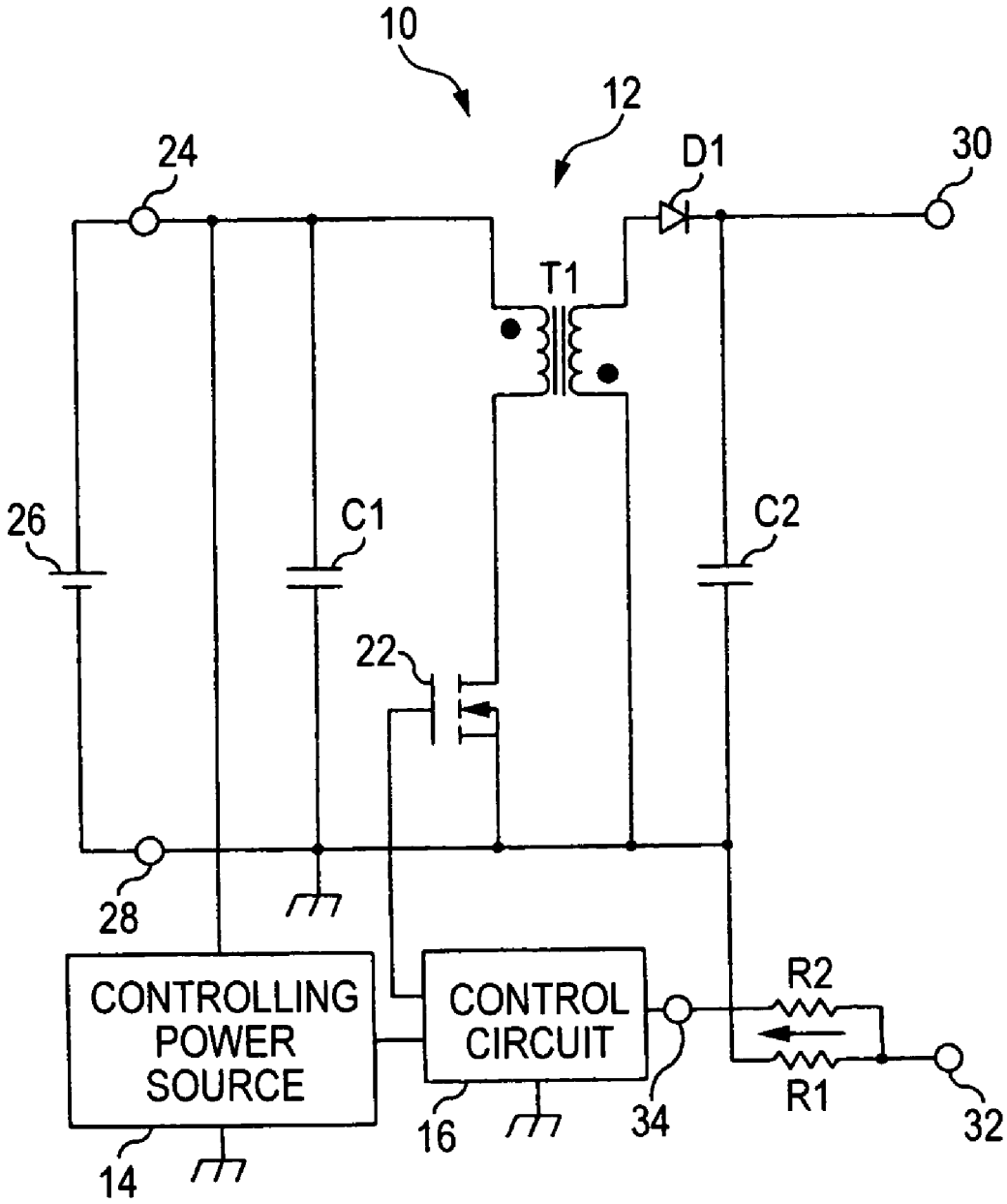
FIG. 2 is a circuit block diagram of a switching regulator.
Figure 3:
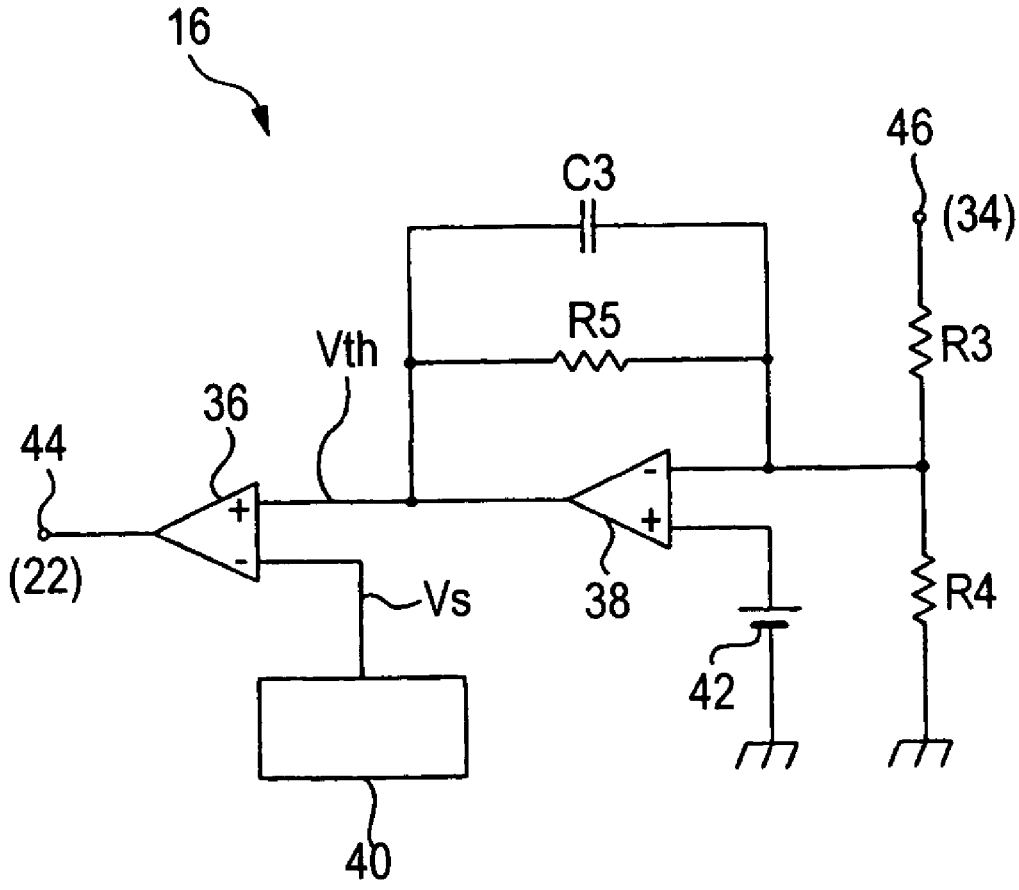
FIG. 3 is a circuit block diagram of a control circuit.
Figure 4:
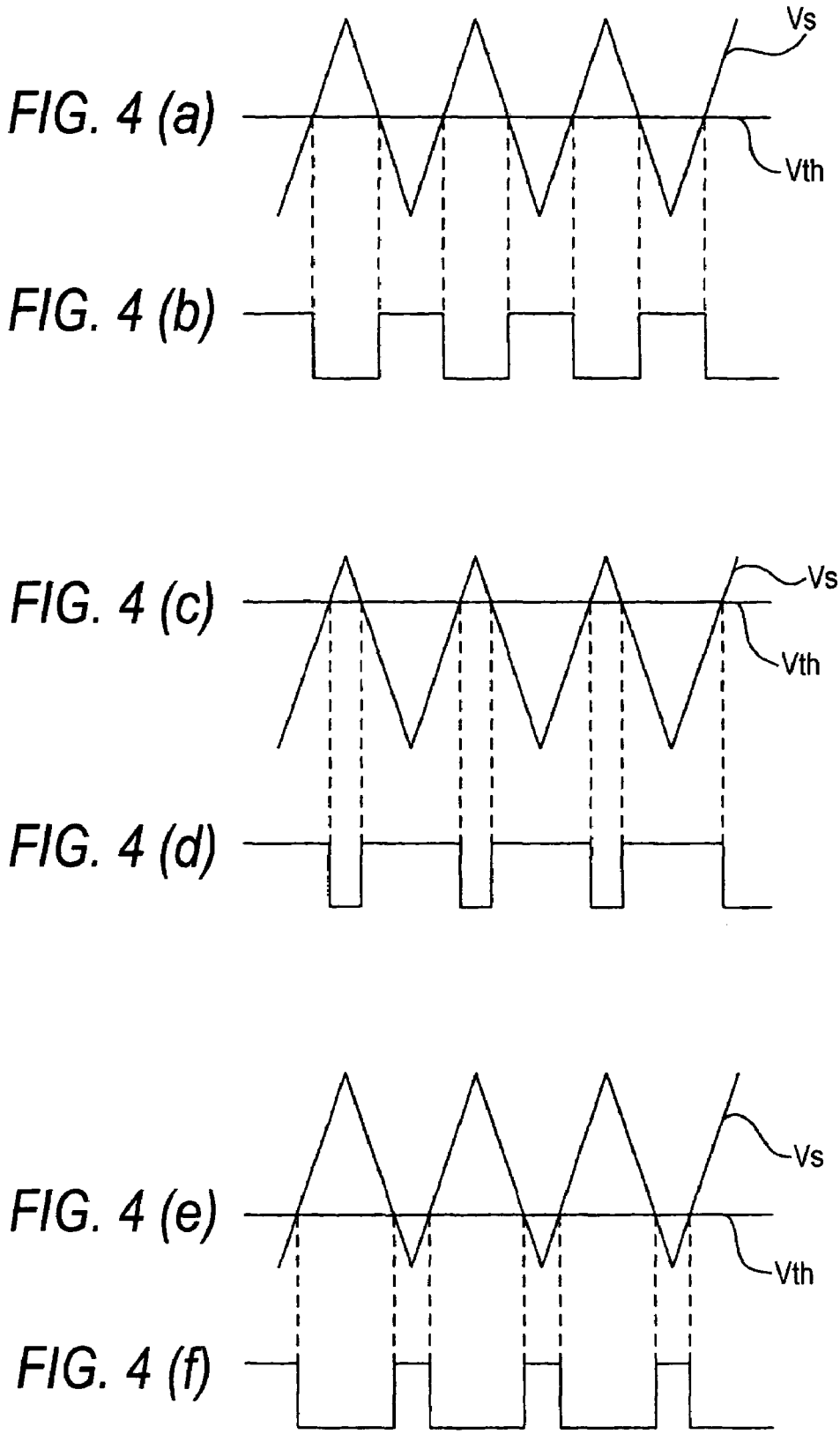
FIG. 4 is a wave form diagram for explaining the operation of the control circuit.
Figure 5:
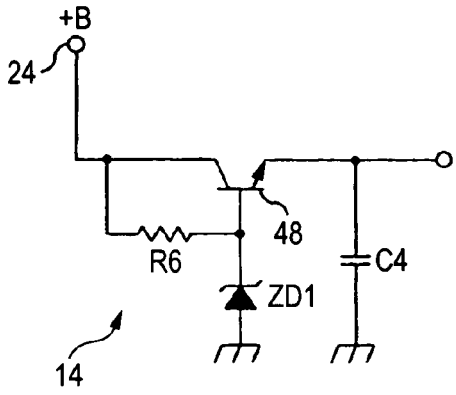
FIG. 5 is a circuit block diagram of a controlling power source.
Figure 6:
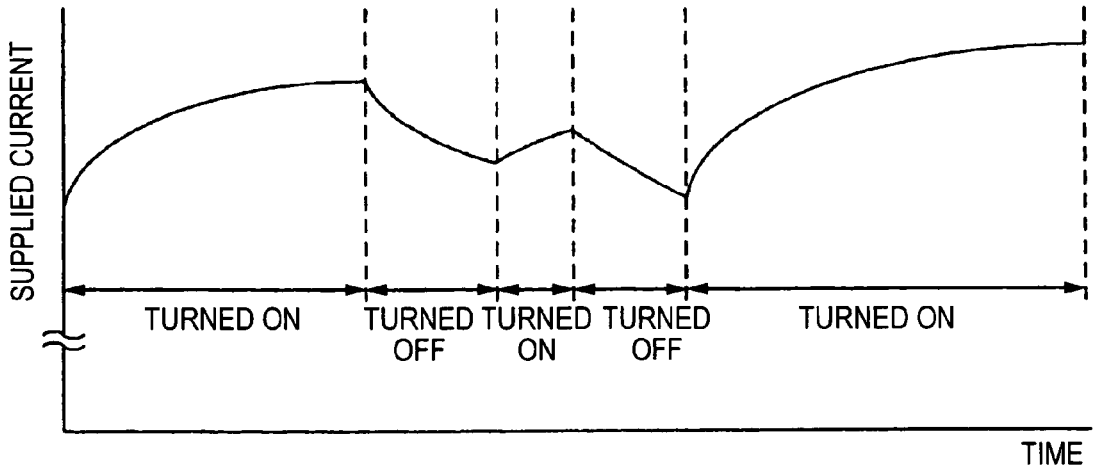
FIG. 6 is a wave form diagram for explaining the relation between a turned on time and a turned off time and a supplied current.
Figure 7:
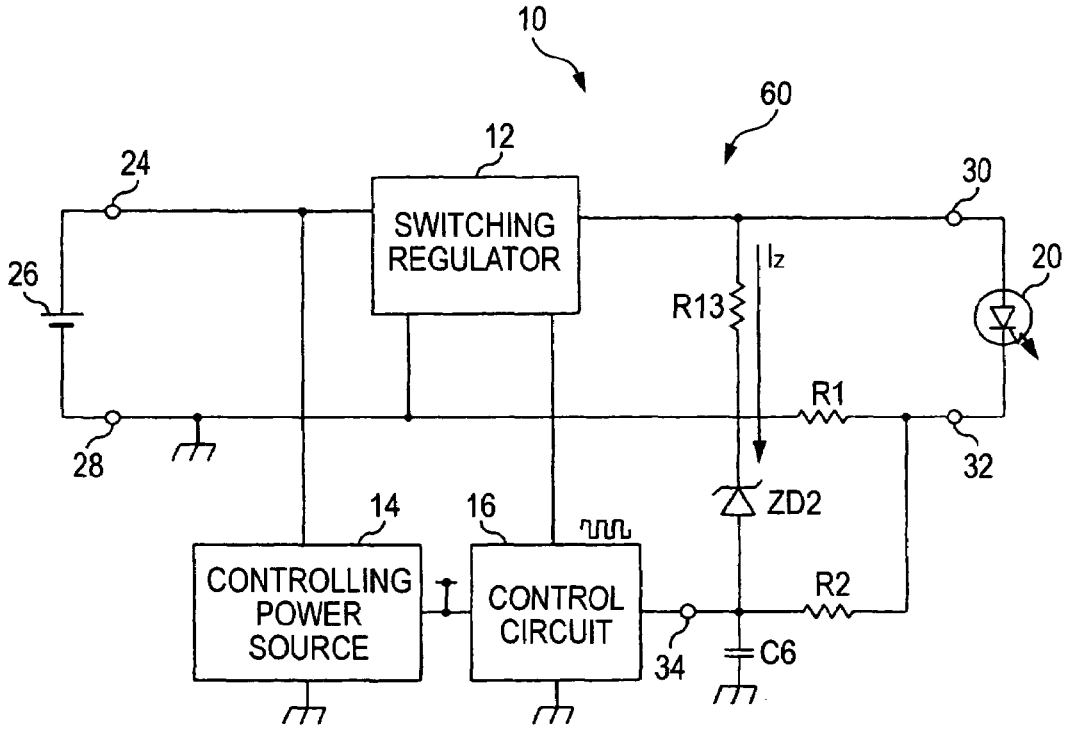
FIG. 7 is a circuit block diagram of a lighting controller for a lighting device for a vehicle showing a second embodiment of the present invention.
Figure 8:
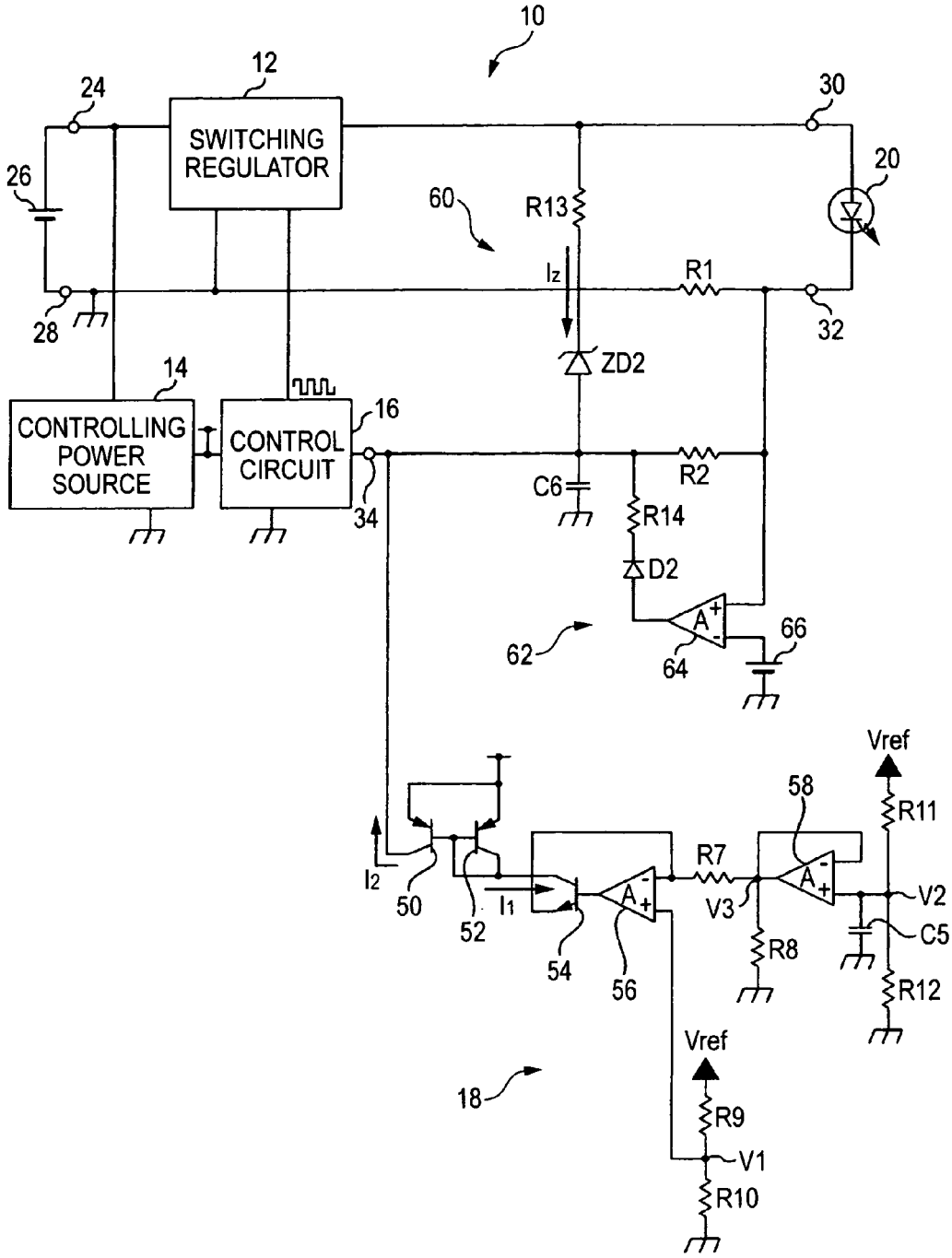
FIG. 8 is a circuit block diagram of a lighting controller for a lighting device for a vehicle showing a third embodiment of the present invention.

Now, embodiments of the present invention will be described below. FIG. 1 is a circuit block diagram of a lighting controller for a lighting device for a vehicle showing a first embodiment of the present invention. FIG. 2 is a circuit block diagram of a switching regulator. FIG. 3 is a circuit block diagram of a control circuit. FIG. 4 is a wave form diagram for explaining an operation of the control circuit. FIG. 5 is a circuit block diagram of a controlling power source. FIG. 6 is a wave form diagram for explaining the relation between a turned on time and a turned off time and a supplied current. FIG. 7 is a circuit block diagram of a lighting controller for a lighting device for a vehicle showing a second embodiment of the present invention. FIG. 8 is a circuit block diagram of a lighting controller for a lighting device for a vehicle showing a third embodiment of the present invention.

In these drawings, the lighting controller 10 for a lighting device for a vehicle includes, as shown in FIG. 1, a switching regulator 12, a controlling power source 14, a control circuit 16, a time measuring circuit 18 and shunt resistances R1 and R2. To the switching regulator 12, an LED 20 as a load is connected. The LED 20 is connected in parallel with the output side of the switching regulator 12 as a semiconductor light source composed of semiconductor light emitting elements.

As the LED 20, a plurality of LEDs mutually connected in series may be used, or the plurality of LEDs mutually connected in series may be used as a power source block, or a plurality of power source blocks respectively connected in parallel may be used. Further, a plurality of LED chips mutually accommodated in series in a package may be used in place of the LED 20. Further, the LED 20 may be formed as light sources of various kinds of lighting devices for vehicles such as a head lamp, a stop and tail lamp, a fog lamp and a turn signal lamp.

As shown in FIG. 2, the switching regulator 12 includes a transformer T1, a capacitor C1, an NMOS transistor 22, a diode D1 and a capacitor C2. The capacitor C1 is connected in parallel with a primary side of the transformer T1 and the NMOS transistor 22 is connected in series to the primary side of the transformer T1. One end side of the capacitor C1 is connected to a positive terminal of a battery 26 to be mounted on a vehicle (a dc power source) through a power supply input terminal 24 and the other end side is connected to a negative terminal of the battery 26 to be mounted on a vehicle through a power supply input terminal 28 and grounded. The NMOS transistor 22 has a drain connected to the primary side of the transformer T1, a source grounded, and a gate connected to the control circuit 16. With the secondary side of the transformer T1, the capacitor C2 is connected in parallel through the diode D1. A node of the diode D1 and the capacitor C2 is connected to an anode side of the LED 20 through an output terminal 30. One end side of the secondary side of the transformer T1 is grounded together with one end side of the capacitor C2 and connected to a cathode side of the LED 20 through the shunt resistance R1 and an output terminal 32. The output terminal 32 is connected to the control circuit 16 through the shunt resistance R2 and a current detecting terminal 34. The shunt resistance R1 is formed as a current detecting unit for detecting a current supplied to the LED 20. Voltage generated at both the ends of the shunt resistance R1 is fed back to the control circuit 16 as the current of the LED 20.

The NMOS transistor 22 is formed as a switching element turned on and off in response to an on/off signal (a switching signal) outputted from the control circuit 16. When the NMOS transistor 22 is turned on, an input voltage from the battery 26 to be mounted on a vehicle is accumulated in the transformer T1 as electromagnetic energy. When the NMOS transistor 22 is turned off, the electromagnetic energy accumulated in the transformer T1 is discharged to the LED 20 as light emitting energy from the secondary side of the transformer T1 through the diode D1.

That is, the switching regulator 12 is constructed as a current supply control unit for receiving the supply of an electric power from the battery 26 to be mounted on a vehicle and controlling the supply of the current to the LED 20 together with the control circuit 16. In this case, the switching regulator 12 compares the voltage of the current detecting terminal 34 with a prescribed voltage to control an output current in accordance with the result of the comparison.

Specifically, the control circuit 16 for controlling the switching regulator 12 includes, as shown in FIG. 3, a comparator 36, an error amplifier 38, a saw tooth wave generator 40, a resistance voltage 42, resistances R3, R4 and R5 and a capacitor C3. An output terminal 44 of the comparator 36 is directly connected to the gate of the NMOS transistor 22 or through a current amplifying preamplifier (not shown in the drawing). An input terminal 46 connected to one end of the resistance R3 is connected to the current detecting terminal 34. To the input terminal 46, voltage fed back from the current detecting terminal 34 is applied. The resistances R3 and R4 divide the voltage applied to the input terminal 46 to apply the voltage obtained by dividing the voltage to a negative input terminal of the error amplifier 38. The error amplifier 38 outputs voltage corresponding to the difference between the voltage applied to the negative input terminal and the reference voltage 42 to a positive input terminal of the comparator 36 as a threshold value Vth. The comparator 36 takes in a saw tooth wave Vs to a negative input terminal from the saw tooth wave generator 40 to compare the saw tooth wave Vs with the threshold value Vth and outputs an on/off signal corresponding to the compared result to the gate of the NMOS transistor 22.

As shown in FIGS. 4(*a*) and 4(*b*), when the level of the threshold value Vth is located at a substantially intermediate part of the saw tooth wave Vs, the on/off signal of on duty as high as about 50% is outputted. On the other hand, when the level of the voltage fed back from the current detecting terminal 34 is lower than the reference voltage 42 as the output current of the switching regulator 12 is decreased, the level of the threshold value Vth by the output of the error amplifier 38 is high. Thus, as shown in FIGS. 4(*c*) and 4(*d*), the on/off signal of on duty higher than 50% is outputted from the comparator 36. As a result, the output current of the switching regulator 12 is increased.

On the contrary, when the level of the voltage fed back from the current detecting terminal 34 is higher than the reference voltage 42 as the output current of the switching regulator 12 is increased and the level of the threshold value Vth by the output of the error amplifier 38 is lowered, the on/off signal of on duty lower than 50% is outputted from the comparator 36, as shown in FIGS. 4(*e*) and 4(*f*). As a result, the output current of the switching regulator 12 is decreased. A chopping wave generator for generating a chopping wave (a chopping wave signal) can be used in place of the saw tooth wave generator 40.

Further, to the control circuit 16, the electric power is supplied from the controlling power source 14. The controlling power source 14 includes, as shown in FIG. 5, an NPN transistor 48 as a series regulator, a resistance R6, a Zener diode ZD1 and a capacitor C4. A collector of the NPN transistor 48 is connected to the power supply input terminal 24 and an emitter is connected to the control circuit 16 through an output terminal. When a supply voltage is applied to the NPN transistor 48 from the power supply input terminal 24, the NPN transistor 48 outputs voltage corresponding to Zener voltage generated at both the ends of the Zener diode ZD1 to the control circuit 16 from the emitter through the output terminal.

As shown in FIG. 1, the time measuring circuit 18 includes PNP transistors 50 and 52, an NPN transistor 54, operation amplifiers 56 and 58, resistances, R7, R8, R9, R10, R11, and R12, and capacitor C5.

The PNP transistors 50 and 52 form a current mirror circuit. The PNP transistor 50 has a collector connected to the current detecting terminal 34 and connected to the output terminal 32 through the resistance R2. The PNP transistor 52 has a collector connected to the collector of the NPN transistor 54 together with a base. The NPN transistor 54 has an emitter connected to a negative input terminal of the operation amplifier 56 and connected to the output side of the operation amplifier 58 through the resistance R7. To the negative input terminal of the operation amplifier 56, the output voltage of the operation amplifier 58 is applied through the resistance R7. To a positive input terminal of the operation amplifier 56, a voltage V1 obtained by dividing a reference voltage Vref by the resistance R9 and the resistance R10 is applied. The voltage V1 obtained by dividing the reference voltage by the resistance R9 and the resistance R10 is set so as to meet voltage at the time of full charge, of the voltage V2 generated at both the ends of the capacitor C5 and a current I1 corresponding to a potential difference between the output voltage V3 of the operation amplifier 58 and the voltage V1 is supplied through the resistance R7. When the current I1 is supplied to the PNP transistor 52 of the current mirror circuit, a current 12 equal to the current I1 is allowed to flow through the PNP transistor 50 and the resistance R2. Each of the currents I1 and I2 is set to be "0" when the voltage V1=V3. To the positive input terminal of the operation amplifier 58, the voltage generated at both the ends of the capacitor C5 or the voltage V2 obtained by dividing the reference voltage Vref by the resistance R11 and the resistance R12 is applied. The voltage V2 generated at both the ends of the capacitor C5 is gradually boosted in accordance with a time constant determined from the resistances R11 and R12 and the capacitor C5 when the LED 20 is turned on by turning on a power source. That is, as the turned on time is longer, the voltage V2 is sequentially more elevated. Then, when the capacitor C5 is fully charged, the voltage V2 is maintained to a prescribed value. The voltage V2 is amplified by the operation amplifier 58 and outputted as the voltage V3. As the turned on time is longer, the voltage V3 is also more elevated like the voltage V2. When the capacitor C5 is fully charged, the potential difference between the voltage V3 and the voltage V1 becomes 0 so that the currents I1 and I2 are not supplied to the current mirror circuit.

On the other hand, when a power switch is turned off so that the LED 20 is turned off, an electric charge accumulated in the capacitor C5 is discharged through the resistances R11 and R12 and the voltage V2 is sequentially lowered in accordance with the time constant. As the turned off time is longer, the voltage V2 is further lowered. When the electric charge of the capacitor C5 is exhausted, the voltage V2 becomes 0V. However, as the turned off time is shorter like a case that the LED 20 is turned on again in a short time after the LED 20 is turned off, the electric charge is accumulated in the capacitor C5, so that the voltage V2 is higher than 0V. Therefore, when the turned off time is long and the LED 20 is turned on after the electric charge of the capacitor C5 is exhausted, the potential difference between the voltage V1 and the voltage V3 is large. Thus, the value of the currents I1 and I2 at the beginning to turn on the LED 20 is large. On the contrary, when the turned off time is short and a large quantity of electric charge is accumulated in the capacitor C5, if the LED 20 is turned on, the potential difference between the voltage V1 and the voltage V3 is small. Thus, the value of the currents I1 and I2 at the beginning to turn on the LED 20 is small.

Here, the control circuit 16 performs a control in such a way that, as the current I2 acting on the resistance R2 is smaller (as the turned on time is longer) so as to make the voltage of the current detecting terminal 34 constant, the supply current (output current) of the switching regulator 12 is gradually increased as shown in FIG. 6. Therefore, when the LED 20 is turned on, as the electric charge is accumulated in the capacitor C5, the voltage V2 is elevated, so that the current I2 acting on the resistance R2 is sequentially decreased in accordance with the rise of the voltage V2. Accordingly, the current supplied to the LED 20 is sequentially increased.

In such a way, when the LED 20 is turned on, the current supplied to the LED 20 is increased at the time of initial turning on of the LED 20 in accordance with the rise of the temperature of the LED 20. Thus, the light flux of the LED 20 can be prevented from being decreased and the quantity of light of the LED 20 can be controlled to be constant. As a result, The LED 20 can be prevented from being dark.

When the capacitor C5 is fully charged and the voltage V1 is equal to the voltage V3 under a state that the LED 20 is turned on, the current I2 acting on the resistance R2 becomes 0 and the control circuit 16 shifts to a constant current control for maintaining the output current of the switching regulator 12 to a prescribed current (a limit value). In this case, the current supplied to the LED 20 is limited to a value not higher than the limit value (the prescribed current) so that the thermo-runaway of the LED 20 can be prevented.

On the other hand, when the LED 20 is turned on again after the LED 20 is turned off, as the turned off time is shorter, the value of the current 12 acting on the resistance R2 is smaller as shown in FIG. 6, so that the value of the current of the LED 20 at the time of initial turning on of the LED 20 is high. Thus, the quantity of light of the LED 20 can be maintained to be constant even at the time of initial turning on of the LED 20. Accordingly, the LED 20 can be prevented from being dark.

According to this embodiment, because the temperature of the LED 20 is indirectly measured, the turned on time and the turned off time of the LED 20 are measured. Then, as the turned on time of the LED 20 is longer, the value of the current supplied to the LED 20 is sequentially further increased. Accordingly, a quantity of the emitted light of the LED 20 can be prevented from being lowered in accordance with the rise of the temperature of the LED 20 and the quantity of the emitted light of the LED 20 can be maintained to be constant. Further, when the LED 20 is initially turned on, as the turned off time is shorter, the value of the current supplied to the LED 20 is further increased, so that the quantity of the emitted light of the LED 20 can be prevented from being lowered during turning on the LED 20 and the quantity of the emitted light of the LED 20 can be maintained to be constant. That is, according to this embodiment, the current of the LED 20 is controlled to meet the change of the temperature of the LED 20, and accordingly, the quantity of the emitted light of the LED 20 can be maintained to be constant irrespective of the temperature of the LED 20 and the LED 20 can be prevented from being dark.

Now, a second embodiment of the present invention will be described below with reference to FIG. 7. In this embodiment, a voltage detecting circuit 60 for detecting the forward voltage of an LED 20 is provided in place of the time measuring circuit 18 and other structures are the same as those shown in FIG. 1. The voltage detecting circuit 60 includes a resistance R13, a Zener diode ZD2 and a capacitor C6 as a voltage detecting unit for detecting the forward voltage of the LED 20. The resistance R13 is connected in series to the Zener diode ZD2. One end side of the resistance R13 is connected to an output terminal 30 and an anode side of the Zener diode ZD2 is connected to a current detecting terminal 34. To the anode side of the Zener diode ZD2, the capacitor C6 is connected and one end side of the capacitor C6 is grounded.

The Zener voltage of the Zener diode ZD2 is set so as to meet a forward voltage Vf at a low temperature of the forward voltage Vf generated at both the ends of the LED 20. As the voltage applied to the LED 20 is higher, a larger current as a Zener current Iz is supplied to the Zener diode ZD2. On the contrary, as the forward voltage Vf of the LED 20 is lower with the rise of the temperature of the LED 20, a smaller current as the Zener current Iz is allowed to flow to the Zener diode.

Accordingly, at the time of initial turning on of the LED 20, when the voltage applied to the LED 20 is higher than the Zener voltage of the Zener diode ZD2, the Zener current Iz is supplied to a resistance R2 through the Zener diode ZD2. After that, the LED 20 is continuously turned on and as the turned on time of the LED 20 is longer, the forward voltage Vf of the LED 20 is sequentially lowered. Accordingly, the value of the Zener current Iz is also sequentially decreased. At this time, a control circuit 16 performs a control in such a way that as the turned on time of the LED 20 is longer, namely, the forward voltage Vf is lower, the value of the current supplied to the LED 20 is sequentially further increased to maintain the voltage of the current detecting terminal 34 to be constant. As a result, even when the forward voltage Vf is sequentially lowered with the rise of the temperature of the LED 20, because the value of the current supplied to the LED 20 is sequentially increased, the quantity of light of the LED 20 can be maintained to be constant and the LED 20 can be prevented from being dark.

During a process that the current supplied to the LED 20 is increased, when the forward voltage Vf of the LED 20 is equal to the Zener voltage of the Zener diode ZD2, the Zener current Iz is 0 and the current acting on the resistance R2 also becomes 0. When the current Iz acting on the resistance R2 is 0, the control circuit 16 shifts to a constant current control for maintaining the output current of a switching regulator 12 to be a prescribed current (a limit value). In this case, the current supplied to the LED 20 is limited to the limit value (the prescribed current) or lower so that the thermo-runaway of the LED 20 can be prevented.

In this embodiment, as the turned on time of the LED 20 is longer, the control is performed that the value of the current supplied to the LED 20 is sequentially increased. Accordingly, even when the forward voltage Vf is sequentially lowered in accordance with the rise of the temperature of the LED 20, since the value of the current supplied to the LED 20 is sequentially increased, the quantity of light of the LED 20 can be maintained to be constant and the LED 20 can be prevented from being dark.

Now, a third embodiment of the present invention will be described with reference to FIG. 8. In this embodiment, the first embodiment is combined with the second embodiment and a limiter circuit 62 is provided.

The limiter circuit 62 includes an operation amplifier 64, a resistance R14, a diode D2 and a reference voltage 66. To the negative input terminal of the operation amplifier 64, the reference voltage 66 is applied. A positive input terminal of the operation amplifier 64 is connected to an output terminal 32 and to one end side of a resistance R2. An output side of the operation amplifier 64 is connected to a current detecting terminal 34 through the diode D2 and the resistance R14.

The reference voltage 66 is set to the same voltage as a voltage drop when the value of a current desired to be limited is supplied to a resistance R1. The operation amplifier 64 does not operate until the voltage of the positive input terminal of the operation amplifier 64 is equal to the reference voltage 66 of the negative input terminal during a process that as the forward voltage Vf of an LED 20 is lowered in accordance with the rise of the temperature of the LED 20, and accordingly, a Zener current Iz is sequentially decreased. Along therewith, a control circuit 16 performs a control for sequentially increasing the output current of a switching regulator 12. Then, when the forward voltage Vf is sequentially lowered in accordance with the rise of the temperature of the LED 20, the current supplied to the LED 20 is increased and the voltage drop of the resistance R1 reaches the reference voltage 66, the operation amplifier 64 supplies the current as a source.

Namely, the output of the operation amplifier 64 is maintained to be a low level until the positive input terminal of the operation amplifier 64 corresponds to the reference voltage 66. As the forward voltage of the LED 20 is lowered, the current value of the Zener current Iz supplied to the resistance R2 is also sequentially decreased. Then, when the voltage of the positive input terminal of the operation amplifier 64 corresponds to the reference voltage 66, the output of the operation amplifier 64 becomes a high level, so that a current through the diode D2 and the resistance R14 is supplied to the resistance R2 in addition to the Zener current Iz. At this time, the current supplied to the shunt resistance R1 serves as a limit value (a prescribed current). The current limited to a value not higher than the limit value is supplied to the LED 20 and the switching regulator 12 shifts to a constant current control.

In this case, before the forward voltage Vf of the LED 20 is equal to the Zener voltage of a Zener diode ZD2, the value of the current to be supplied to the LED 20 is controller to a value not higher than the limit value by the limiter circuit 62.

In this embodiment, as the turned on time of the LED 20 is longer, the control is performed that the value of the current supplied to the LED 20 is sequentially increased. Accordingly, even when the forward voltage Vf is sequentially lowered in accordance with the rise of the temperature of the LED 20, because the value of the current supplied to the LED 20 is sequentially increased, the quantity of light of the LED 20 can be maintained to be constant and the LED 20 can be prevented from being dark. Further, because the current supplied to the LED 20 can be limited to the value not higher than the limit value (the prescribed current), the thermo-runaway of the LED 20 can be prevented.

Further, in this embodiment, because the temperature of the LED 20 is indirectly measured, the turned on time and the turned off time of the LED 20 are measured. Then, as the turned on time of the LED 20 is longer, the value of the current supplied to the LED 20 is sequentially further increased. Accordingly, a quantity of the emitted light of the LED 20 can be prevented from being lowered in accordance with the rise of the temperature of the LED 20 and the quantity of the emitted light of the LED 20 can be maintained to be constant. Further, when the LED 20 is initially turned on, as the turned off time is shorter, the value of the current supplied to the LED 20 is further increased, so that the quantity of the emitted light of the LED 20 can be prevented from being lowered during turning on the LED 20 and the quantity of the emitted light of the LED 20 can be maintained to be constant Further, in this embodiment, as the turned on time of the LED 20 is longer, the control is performed that the value of the current supplied to the LED 20 is sequentially increased. Accordingly, even when the forward voltage Vf is sequentially lowered in accordance with the rise of the temperature of the LED 20, because the value of the current supplied to the LED 20 is sequentially increased, the quantity of light of the LED 20 can be maintained to be constant and the LED 20 can be prevented from being dark.

Further, because a voltage detecting circuit 60 is used as a back up of a time measuring circuit 18. Thus, even when the time measuring circuit 18 is failed, because, as the turned on time of the LED 20 is longer, the control is performed that the value of the current supplied to the LED 20 is sequentially increased. Accordingly, the quantity of light of the LED 20 can be maintained to be constant and the LED 20 can be prevented from being dark.

The limiter circuit 62 in this embodiment may be provided in the first embodiment or the second embodiment.

[Description of Reference Numerals and Signs]

10 . . . lighting controller for lighting device for vehicle 12 . . . switching regulator 14 . . . controlling power source 16 . . . control circuit 18 . . . time measuring circuit 20 . . . LED 62 . . . limiter circuit

[FIG. 1]

12 . . . switching regulator 14 . . . controlling power source 16 . . . control circuit

[FIG. 6]

a . . . supplied current b . . . turned on c . . . turned off d . . . time

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A lighting controller for a lighting device for a vehicle comprising:

a current supply control unit for receiving a supply of an electric power from a power source and controlling a supply of a current to a semiconductor light source;

a time measuring unit for measuring a turned on time and a turned off time of the semiconductor light source, wherein the current supply control unit sequentially further increases a value of the current supplied to the semiconductor light source as the turned on time measured by the time measuring unit is longer and further increases a value of the current supplied to the semiconductor light source at the time of initial turning on of the semiconductor light source when the turned off time is shorter;

a voltage detecting unit for detecting a forward voltage of the semiconductor light source, wherein the current supply control unit sequentially further increases the value of the current supplied to the semiconductor light source as the forward voltage detected by the voltage detecting unit is lower, wherein the current supply control unit limits the current supplied to the semiconductor light source to the limit value or lower when the value of the current supplied to the semiconductor light source reaches a limit value; and a limiter circuit for limiting the current supplied to the semiconductor light source to a value that is not higher than the limit value.

2. A lighting controller for a lighting device for a vehicle comprising:

a semiconductor light source;

a power source for supplying electric power;

a control circuitry for receiving the electric power from the power source and controlling a current supplied to the semiconductor light source;

a voltage detecting unit for detecting a forward voltage of the semiconductor light source, wherein the control circuitry controls the value of the current supplied to the semiconductor light source based on the forward voltage detected by the voltage detecting unit; and a limiter circuit for limiting the current supplied to the semiconductor light source, wherein the control circuitry determines an amount of time the semiconductor light source is in a turned on state and an amount of time the semiconductor light source is in a turned off state, wherein the control circuit controls a value of the current supplied to the semiconductor light source based on both the determined amount of time the semiconductor light source is in a turned on state and the determined amount of time the semiconductor light source is in a turned off state, wherein the control circuitry controls the value of the current supplied to the semiconductor light source to be less than or equal to a limit value, and wherein the limiter circuit limits the current supplied to the semiconductor light source to a value that is not higher than the limit value.

3. A method of controlling a lighting device for a vehicle comprising:

receiving electric power from a power source;

supplying a current to a semiconductor light source;

determining an amount of time the semiconductor light source is in a turned on state and an amount of time the semiconductor light source is in a turned off state;

controlling a value of the current supplied to the semiconductor light source based on both the determined amount of time the semiconductor light source is in a turned on state and the determined amount of time the semiconductor light source is in a turned off state;

detecting a forward voltage of the semiconductor light source;

controlling the value of the current supplied to the semiconductor light source based on the detected forward voltage;

limiting the current supplied to the semiconductor light source; and controlling the value of the current supplied to the semiconductor light source to be less than or equal to a limit value, wherein the step of limiting the current supplied to the semiconductor light source limits the current supplied to the semiconductor light source to a value that is not higher than the limit value.

* * * * *